US010422608B2

(12) United States Patent
Yang

(10) Patent No.: US 10,422,608 B2
(45) Date of Patent: Sep. 24, 2019

(54) GUN-CLEARING BOX

(71) Applicant: Cho-Jen Yang, Taichung (TW)

(72) Inventor: Cho-Jen Yang, Taichung (TW)

( * ) Notice: Subject to any disclaimer, the term of this patent is extended or adjusted under 35 U.S.C. 154(b) by 0 days.

(21) Appl. No.: 16/134,975

(22) Filed: Sep. 19, 2018

(65) Prior Publication Data

US 2019/0234715 A1 Aug. 1, 2019

(30) Foreign Application Priority Data

Jan. 31, 2018 (TW) ..... 107103364 A

(51) Int. Cl.
*F41J 13/00* (2009.01)

(52) U.S. Cl.
CPC ..... *F41J 13/00* (2013.01)

(58) Field of Classification Search
CPC ..... F41J 13/00
USPC ..... 273/404, 410; 89/36.02
See application file for complete search history.

(56) References Cited

U.S. PATENT DOCUMENTS 941,642 A * 11/1909 Maxim ..... F41J 13/00 273/410
2,613,934 A * 10/1952 Tabler ..... F41J 1/10 273/404
2,670,959 A * 3/1954 Broyles ..... F41J 11/00 273/406
4,482,027 A * 11/1984 Gould ..... F41J 13/00 181/223
4,787,289 A * 11/1988 Duer ..... F41J 13/00 273/410
5,684,264 A * 11/1997 Cassells ..... F41J 13/00 220/495.11
6,016,735 A * 1/2000 Langner ..... F41J 13/00 273/403
6,128,847 A * 10/2000 Langner ..... F41A 17/54 42/106
6,722,195 B2 * 4/2004 Duke ..... F41J 13/00 273/410
6,732,628 B1 * 5/2004 Coburn ..... F41J 13/00 273/410
6,808,178 B1 * 10/2004 Sovine ..... F41J 13/00 273/410
2002/0088339 A1 * 7/2002 Koffler ..... F41J 13/00 89/36.02
2012/0038110 A1 * 2/2012 Priebe ..... F41J 13/00 273/410

(Continued)

*Primary Examiner* — Mark S Graham
(74) *Attorney, Agent, or Firm* — Leong C. Lei

(57) ABSTRACT

A gun-clearing box, which has: a box-body having a gun-clearing space inside, a cover opening and an assembly opening connecting the gun-clearing space to the outside; a cover-body; a gun-placing barrel having an placing entrance, a shot exit, and a barrel wall connected between, such that the diameter of the placing entrance is larger than which of the shot exit; such that the gun-placing barrel is fixed in the assembly opening, and the placing entrance is faced toward the outside of the box-body, and the shot exit is inclined to face toward the gun-clearing space; and a sliding-sleeve abutting assembly set in the gun-placing barrel, such that the sliding-sleeve abutting assembly has two adjacent abutting surfaces with a gap between; such that the gap is inclined and reduced along the direction from the placing entrance to the shot exit; thereby improving the convenience and safety of the use.

10 Claims, 13 Drawing Sheets

(56) References Cited

U.S. PATENT DOCUMENTS

| | | | | |
|---|---|---|---|---|
| 2012/0181752 | A1* | 7/2012 | Bavaro | F41J 13/00 273/410 |
| 2012/0187631 | A1* | 7/2012 | John | F41J 13/00 273/410 |
| 2015/0084284 | A1* | 3/2015 | Cibrian Vidrio | F41J 13/00 273/410 |
| 2016/0003584 | A1* | 1/2016 | Durynski | F41J 13/02 273/410 |
| 2018/0073837 | A1* | 3/2018 | Bahu | F41C 33/06 |

* cited by examiner

GUN-CLEARING BOX

(a) TECHNICAL FIELD OF THE INVENTION

The present invention relates to a pistol special equipment, and especially relates to a gun-clearing box.

(b) DESCRIPTION OF THE PRIOR ART

Generally, police, military personnel and security personnel, in order to protect the property and life safety of the people, they will wear a long gun or a pistol and will routinely carry out the target practice for the precise shooting accuracy.

After the target-shooting practice, the user of the pistol must perform a gun-cleaning procedure for the pistol to prevent the remaining bullets in the pistol from being accidentally fired.

In the past, the gun-cleaning procedure was carried out aiming to the air or the ground in a wild open place, but the people may still be accidentally injured by the rebound bullets after the shooting.

Therefore, there is one kind of a gun-clearing box currently, such as the Chinese Patent Notice No. 375273 "Pistol Clearing Box", which can be used by the pistol user to carry out the gun-cleaning procedure toward the gun-clearing box and let the shot bullets stay in the rubber pellets or plates inside the gun-clearing box.

However, such kind of a gun-clearing box only has a socket for the insertion of a pistol at the top of a box-body to allow the pistol to perform a gun-cleaning procedure toward the box-body.

Since the diameter of the socket is larger than the outer diameter of the front end of the pistol, after the user inserts the pistol into the socket, the muzzle deflection is extremely likely to occur, so that the projectile is not directed toward the rubber pellets or plates but is directed toward the side of the box-body. As a result, the box-body will be shot through, and there will be accidental injuries caused by the bullets coining out from the box-body.

In addition, in the above-mentioned gun-clearing box, since the user still has to operate the pistol with both hands (such as holding the gun in the right hand and pulling the sliding-sleeve on the left hand), it is inconvenient to use.

SUMMARY OF THE INVENTION

In view of this, in order to improve the prior art, the gun-clearing box of the conventional pistol has problems such as easy deflection of the shooting and inconvenience in operation; Therefore, the present invention provides a gun-clearing box, which mainly comprises: a box-body having a gun-clearing space inside, wherein the top of the box-body has a cover opening connecting the gun-clearing space to the outside, and one side of the box-body has an assembly opening connecting the gun-clearing space to the outside; a cover-body coupled to the box-body to close the assembly opening; a gun-placing barrel having an placing entrance, a shot exit, and a barrel wall connected between the placing entrance and the shot exit, wherein the diameter of the placing entrance is larger than the diameter of the shot exit, which the inner wall of the barrel wall is gradually reduced toward the shot exit from the placing entrance; and a sliding-sleeve abutting assembly set in the gun-placing barrel, wherein the sliding-sleeve abutting assembly has two adjacent abutting surfaces, and has a gap between the two abutting surfaces; wherein the gap between the two abutting surfaces is inclined and reduced along the direction from the placing entrance to the shot exit; thereby improving the convenience and safety of the use.

DETAILED DESCRIPTION OF THE PREFERRED EMBODIMENTS

The following descriptions are exemplary embodiments only, and are not intended to limit the scope, applicability or configuration of the invention in any way. Rather, the following detailed description provides a convenient illustration for implementing exemplary embodiments of the invention.

Various changes to the described embodiments may be made in the function and arrangement of the elements described without departing from the scope of the invention as set forth in the appended claims.

The foregoing and other aspects, features, and utilities of the present invention will be best understood from the following detailed description of the preferred embodiments when read in conjunction with the accompanying drawings.

Figure 1:
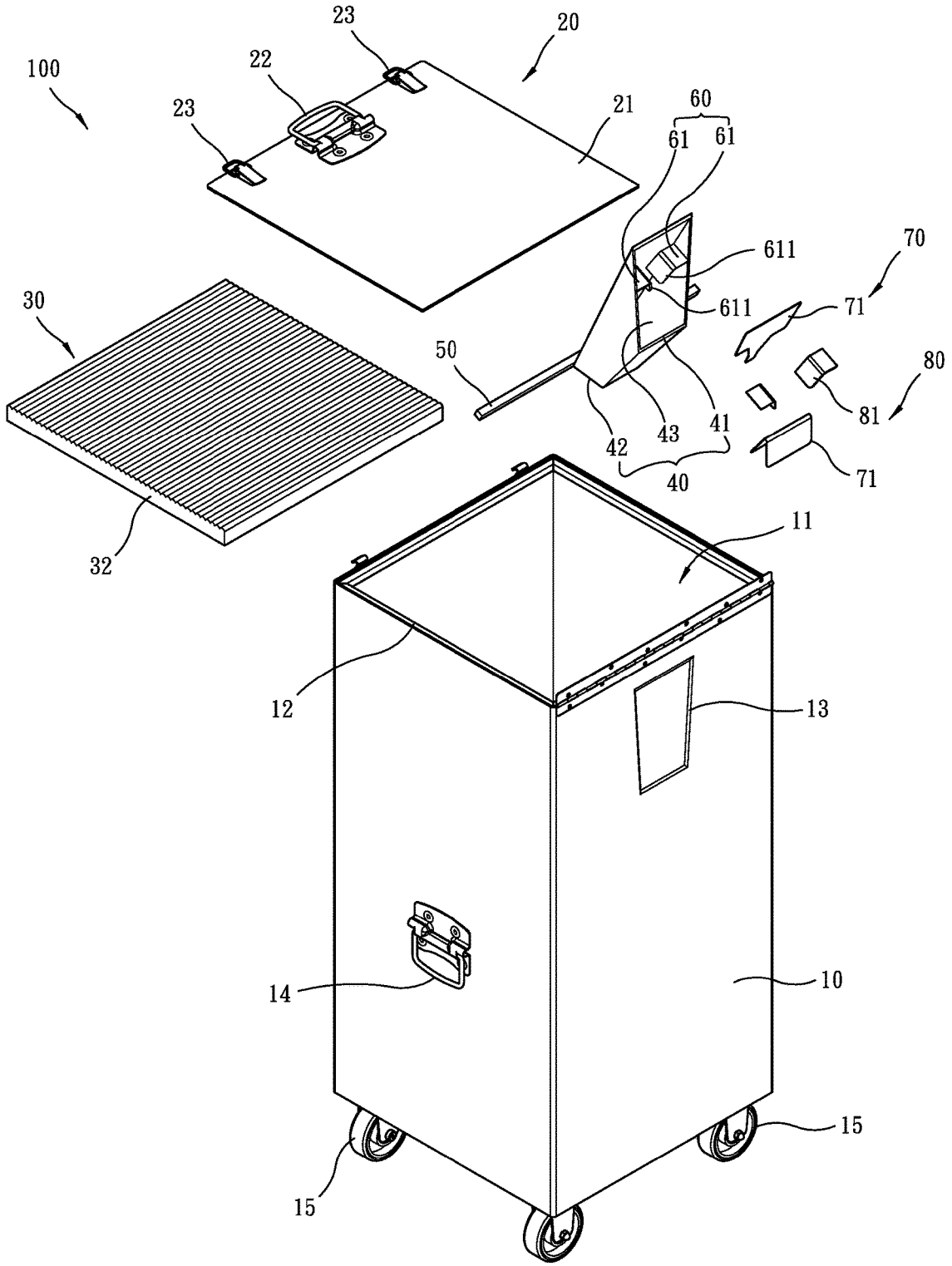
FIG. 1 is an exploded perspective view of a preferred embodiment of the present invention.
Figure 2:
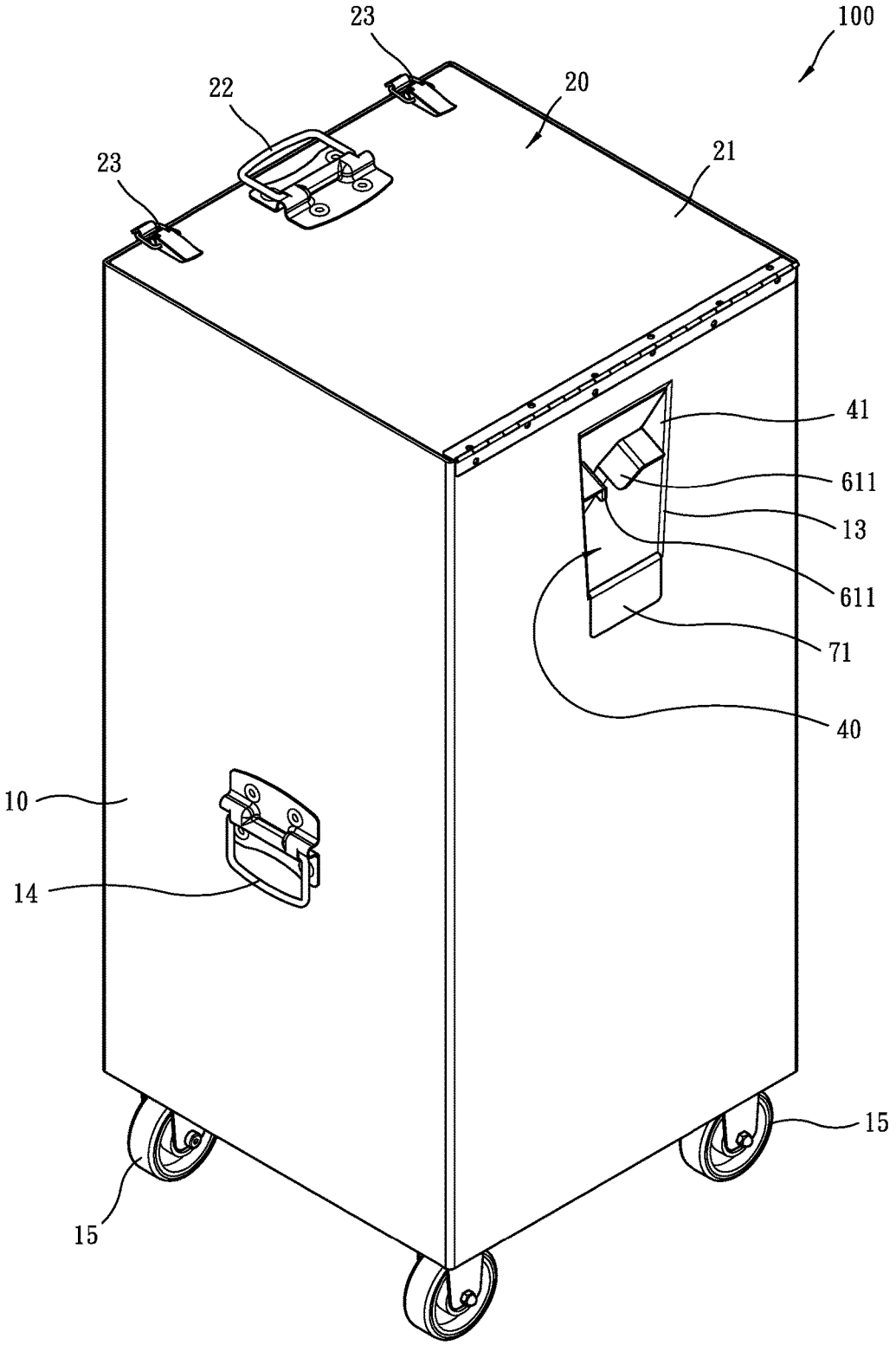
FIG. 2 is the perspective assembled view of the embodiment shown in FIG. 1.
Figure 3:
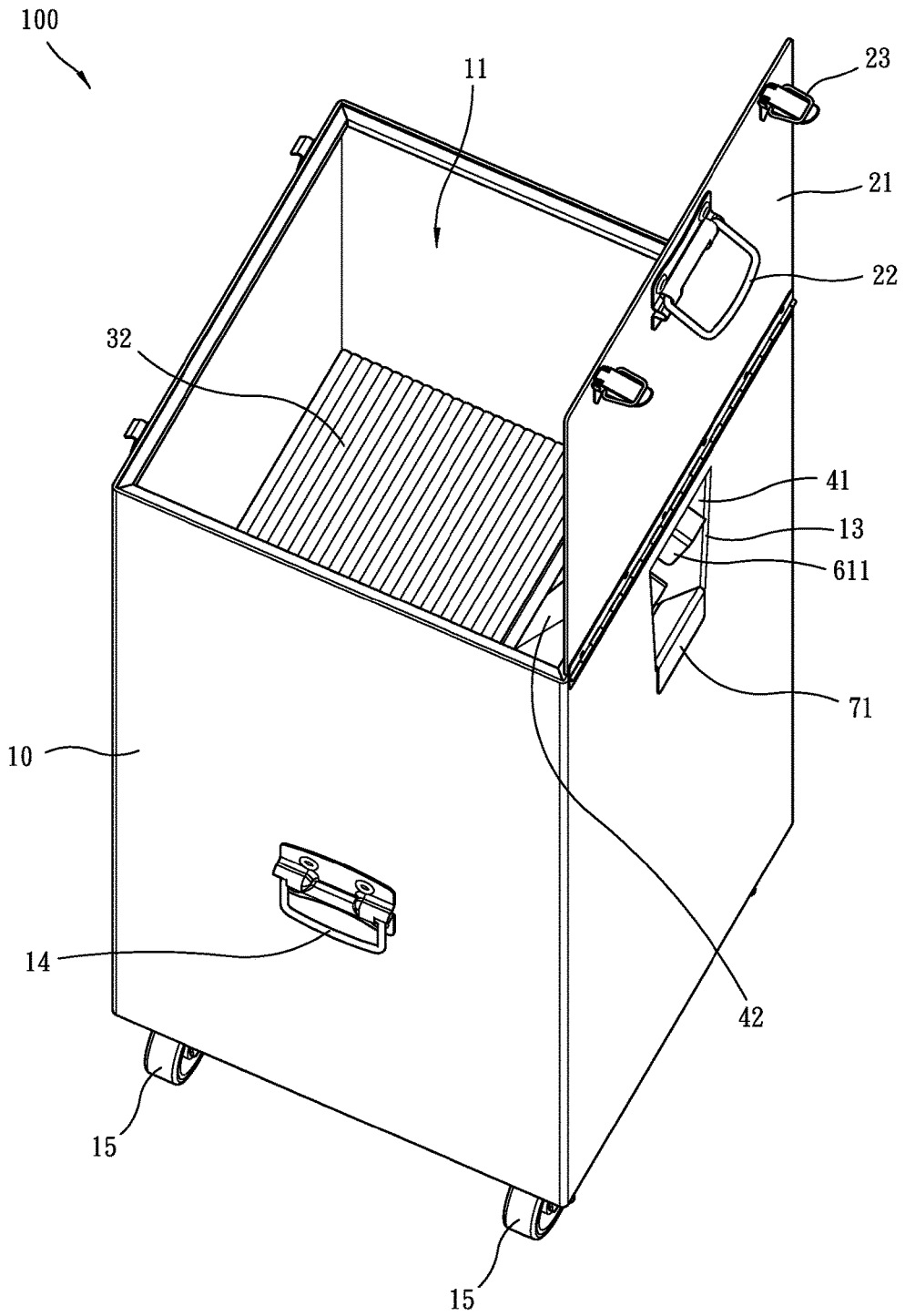
FIG. 3 is the perspective view of the embodiment shown in FIG. 1.
Figure 4:
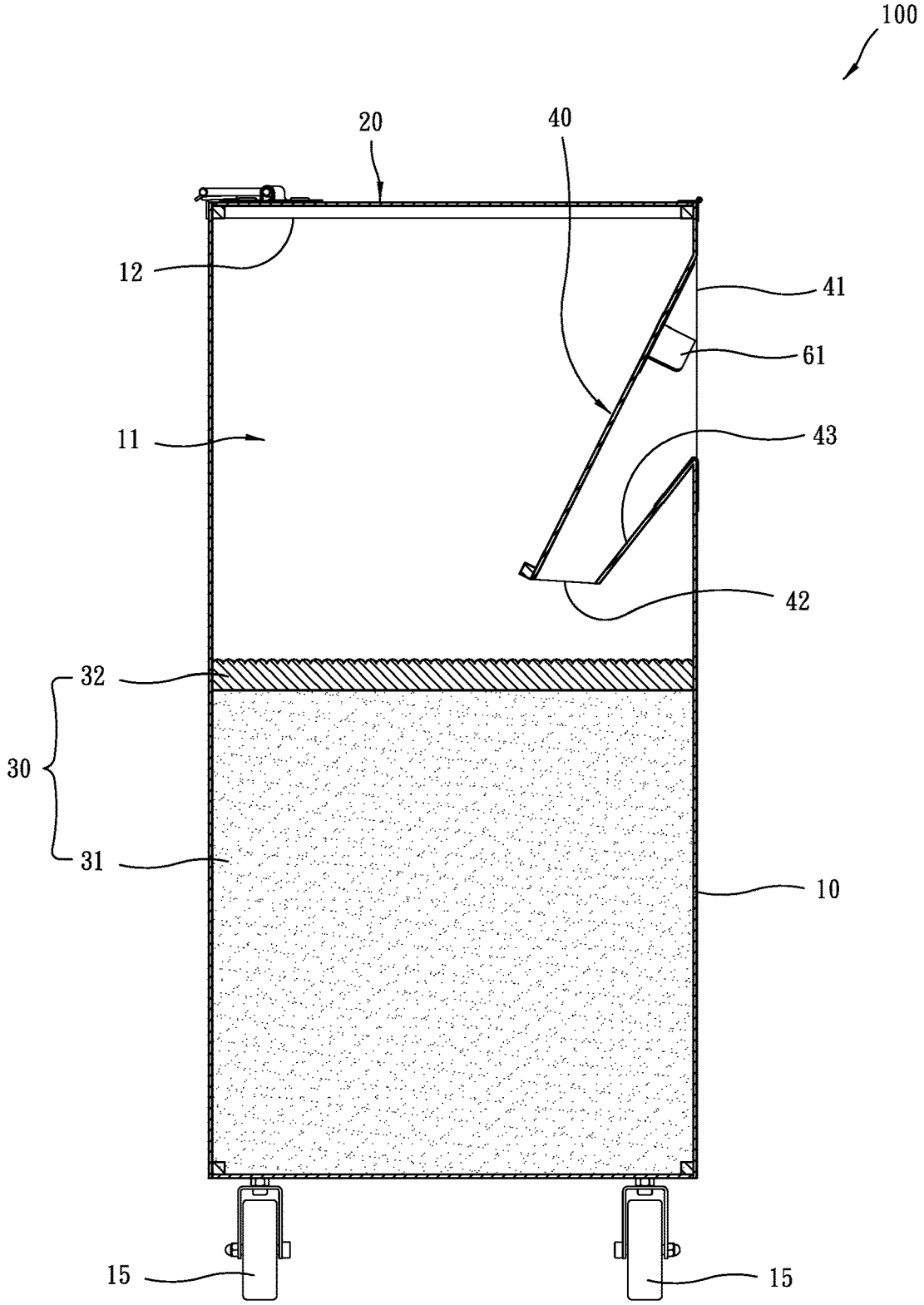
FIG. 4 is a cross-sectional view of the embodiment shown in FIG. 1.
Figure 13:
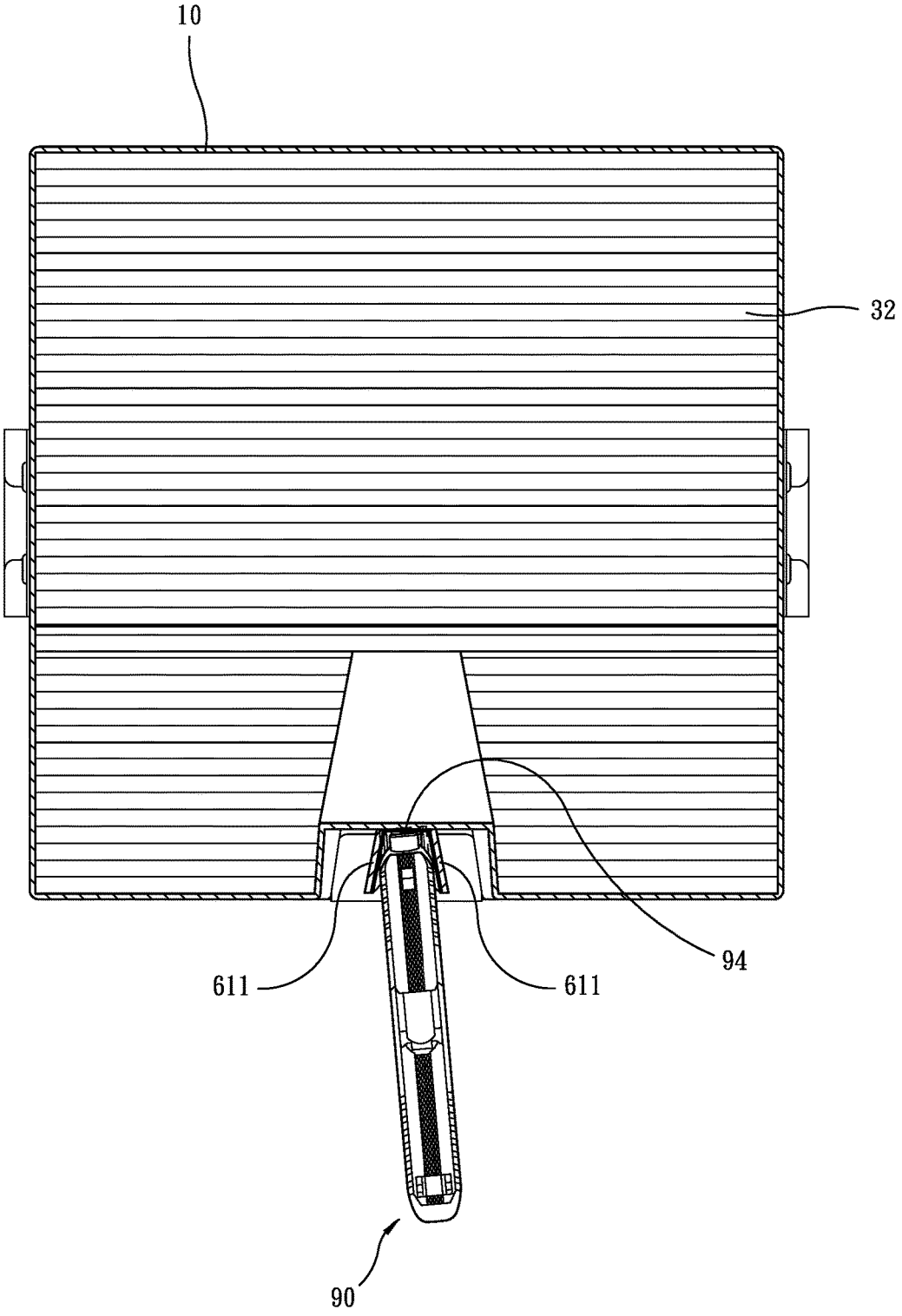

Please refer FIG. 1 and FIG. 13, a clearing gun case 100 according to a preferred embodiment of the present invention comprises a box-body 10, a cover-body 20, a buffer-body 30, and a gun-placing barrel 40. A gun-placing barrel 40, a fastener 50, a sliding-sleeve abutting assembly 60, and a gun-placing barrel, a protective pad assembly 70, and a sliding-sleeve protective pad assembly 80.

Please refer FIG. 1 to FIG. 4, the box-body 10 is made of metal and has a gun-clearing space 11 therein. The top of the box-body 10 has a cover opening 12 connecting with the gun-clearing space 11 to the outside. The position of one side of the box-body 10 adjacent to the top portion has an assembly opening 13 connecting the gun-clearing space 11 to the outside.

Please refer FIG. 1 to FIG. 4, the cover-body 20 is pivotally coupled to the top of the box-body 10 and can be reciprocally pivoted between an open position and a closed position. When the cover-body 20 is in the open position, the cover opening 12 of the box-body 10 communicates with the outside, and when the cover-body 20 is in the closed position, the cover opening 12 of the box-body 10 is closed.

The cover-body 20 has a cover plate 21, a lifting handle 22, and a plurality of buckles 23; wherein the cover plate 21 is pivotally connected to the top of the box-body 10 and can be reciprocally pivoted between the open position and the closed position, and the lifting handle 22 is combined with the top surface of the cover 21 for the hand grasping; and the buckles 23 is set on the cover plate 21, which the buckles 23 are buckled and combined with the box-body 10 when the cover plate 21 is in the closed position.

Please refer FIG. 1 to FIG. 4, the buffer body 30 has a buffer main-body 31 and a buffer surface-layer 32. The buffer main-body 31 is disposed in the gun-clearing space 11 of the box-body 10, and may be a predetermined volume of rubber particles or sand or soil. The buffer surface-layer 32 is a rubber plate and is covered on the top surface of the buffer main-body 31.

Please refer FIG. 1 to FIG. 4, the gun-placing barrel 40 has a rectangular cross section and has a placing entrance 41, a shot exit 42 and a barrel wall 43 connected between the placing entrance 41 and the shot exit 42, wherein he barrel wall 43 has a hollow rectangular cross section and the diameter of the placing entrance 41 is larger than the diameter of the shot exit 42, and the diameter of the inner wall of the barrel wall 43 is gradually reduced from the placing entrance 41 to the shot exit 42. The gun-placing barrel 40 is fixed to the assembly opening 13 of the box-body 10 by an outer wall adjacent to the placing entrance 41, so that the placing entrance 41 faces toward the buffer-body 30 inside the gun-clearing space 11.

Please refer FIG. 1 to FIG. 4, the fastener 50 is connected between the outer wall of the gun-placing barrel 40 adjacent to the shot exit 42 and the inner wall of the gun-clearing space 11 of the box-body 10 to strengthen the fixing strength between the gun-placing barrel 40 and the box-body 10.

Please refer FIG. 1 to FIG. 4, the sliding-sleeve abutting assembly 60 has two abutting pieces 61, wherein the abutting pieces 61 are substantially L-shaped and are fixed in the barrel wall 43 of the gun-placing barrel 40, and each of the abutting pieces 61 respectively has an adjacent abutting surface 611. The two abutting surfaces 611 have a gap there between, and the gap between the two abutting surfaces 611 is gradually reduced and inclined from one end of the placing entrance 41 toward the end of the shot exit 42.

Please refer FIG. 1 to FIG. 4, the protective pad assembly 70 of the gun-placing barrel 40 is a plurality of elastic pad-bodies 71 attached to the barrel wall 43 of the gun-placing barrel 40 adjacent to the placing entrance 41.

Please refer FIG. 1 to FIG. 4, the sliding-sleeve protective pad assembly 80 is a two elastic pad-body 81 which is respectively attached to the abutting surfaces 611 of the two abutting pieces 61 of the sliding-sleeve abutting assembly 60.

Figure 5:
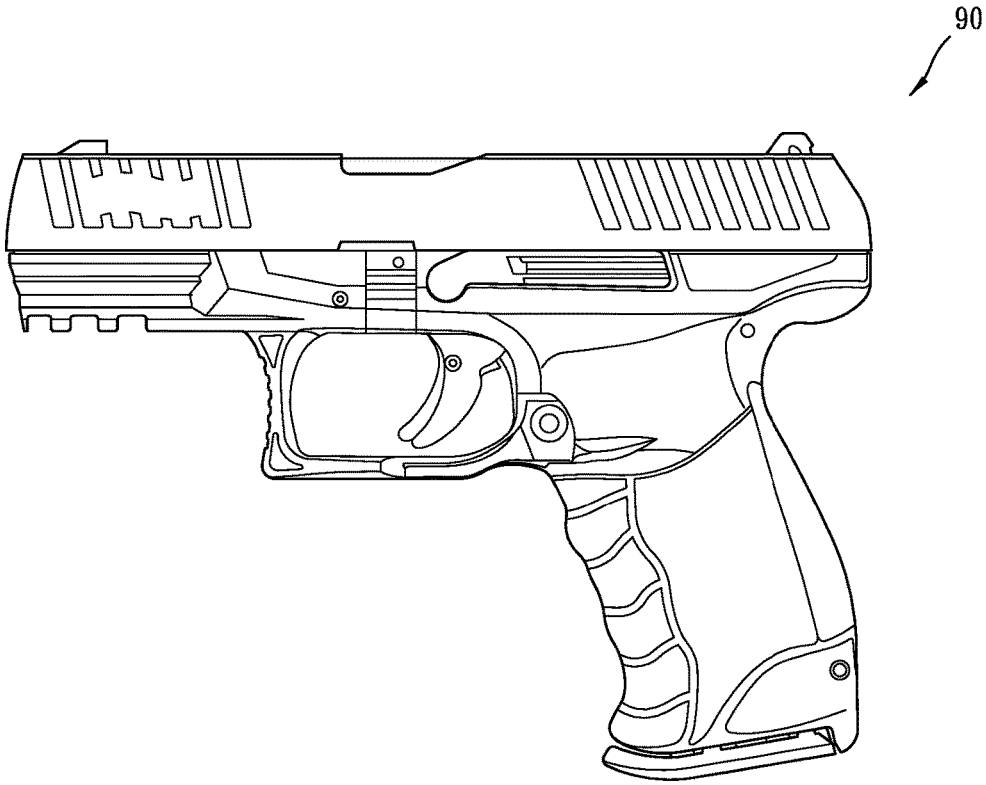
FIG. 5 is a schematic diagram of a pistol.
Figure 6:
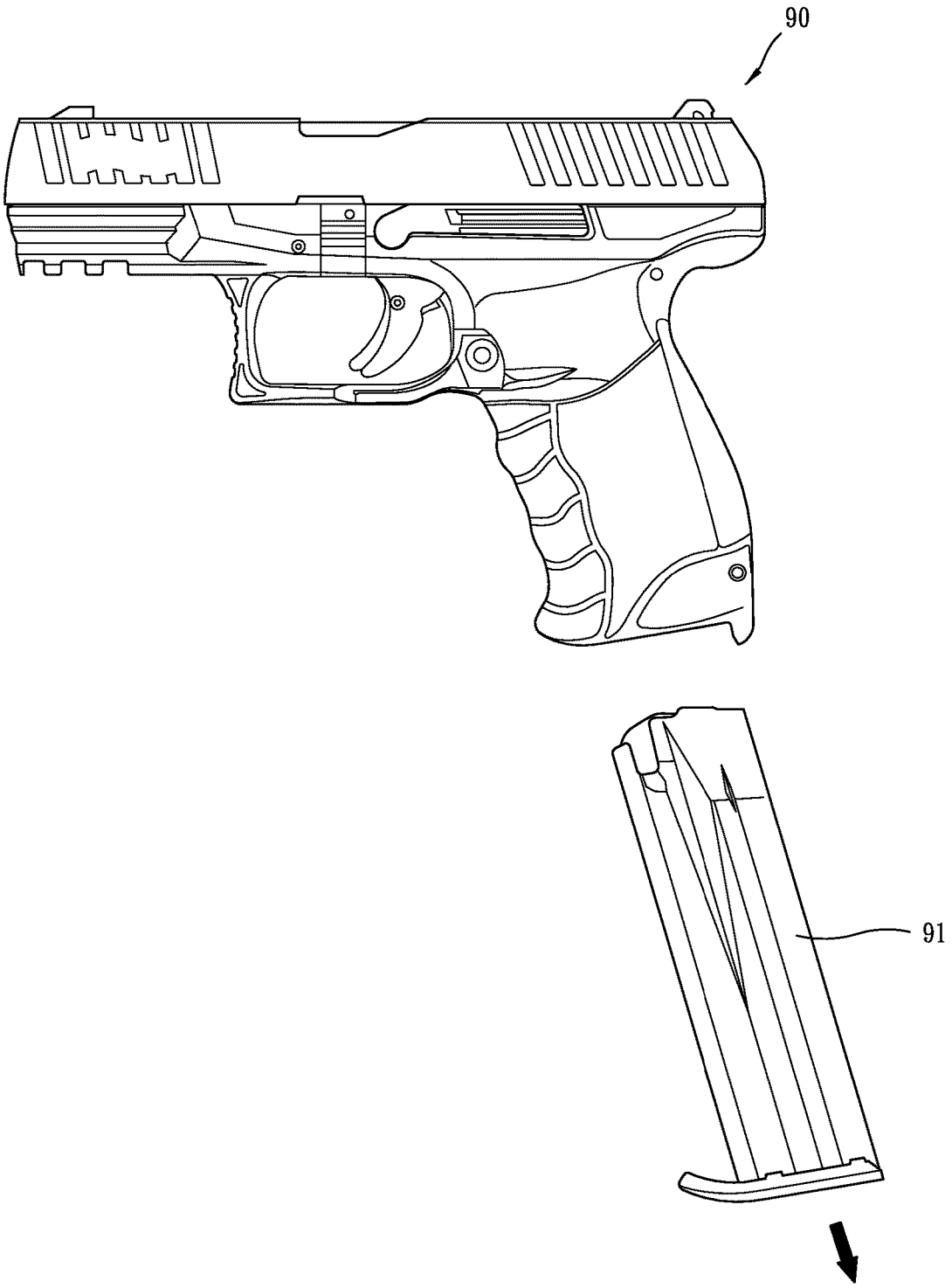
FIG. 6 is a schematic diagram of a pistol withdrawing the magazine.
Figure 7:
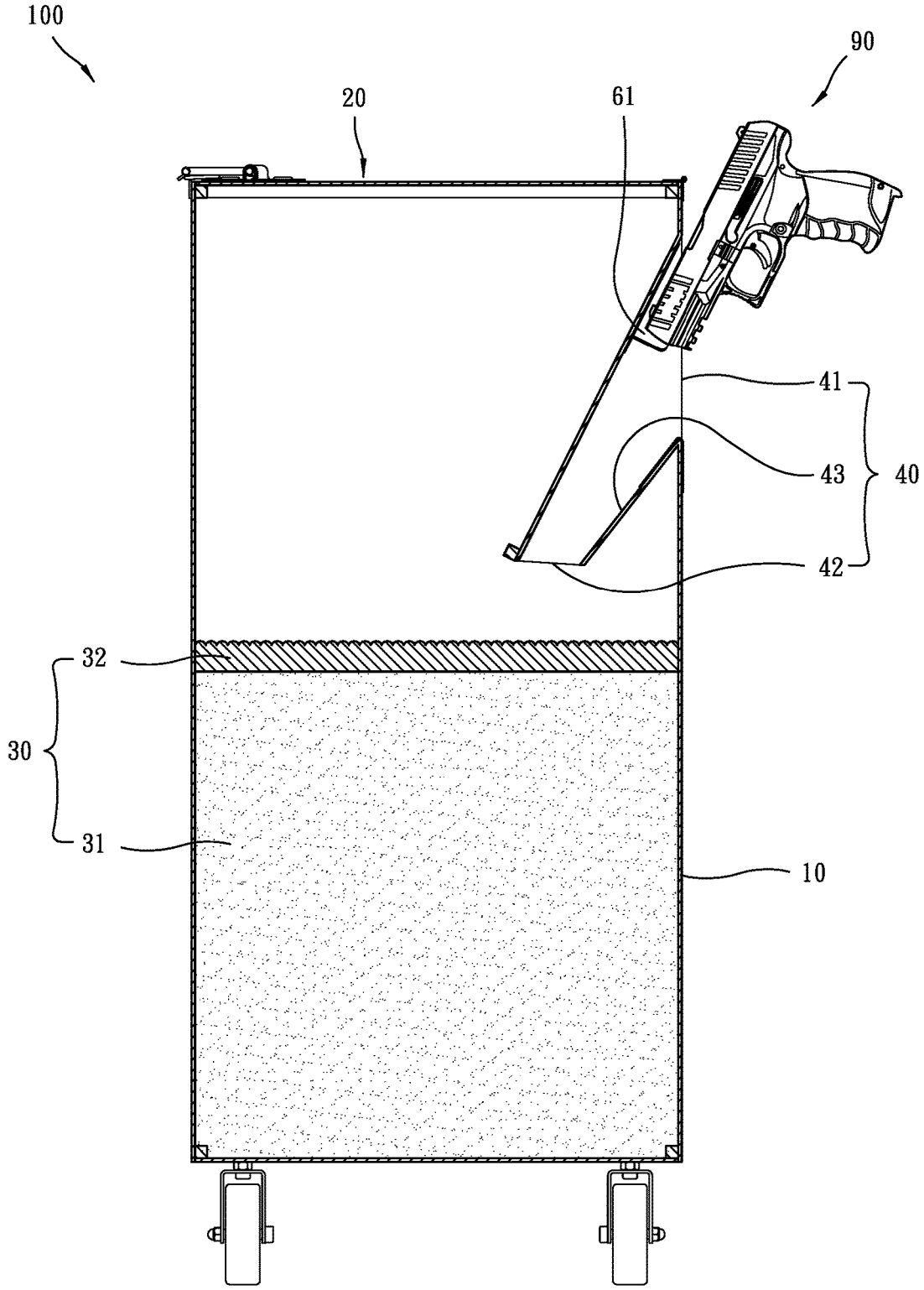
FIG. 7 to FIG. 13 are the schematic diagrams showing the state of use of the embodiment shown in FIG. 1.
Figure 8:
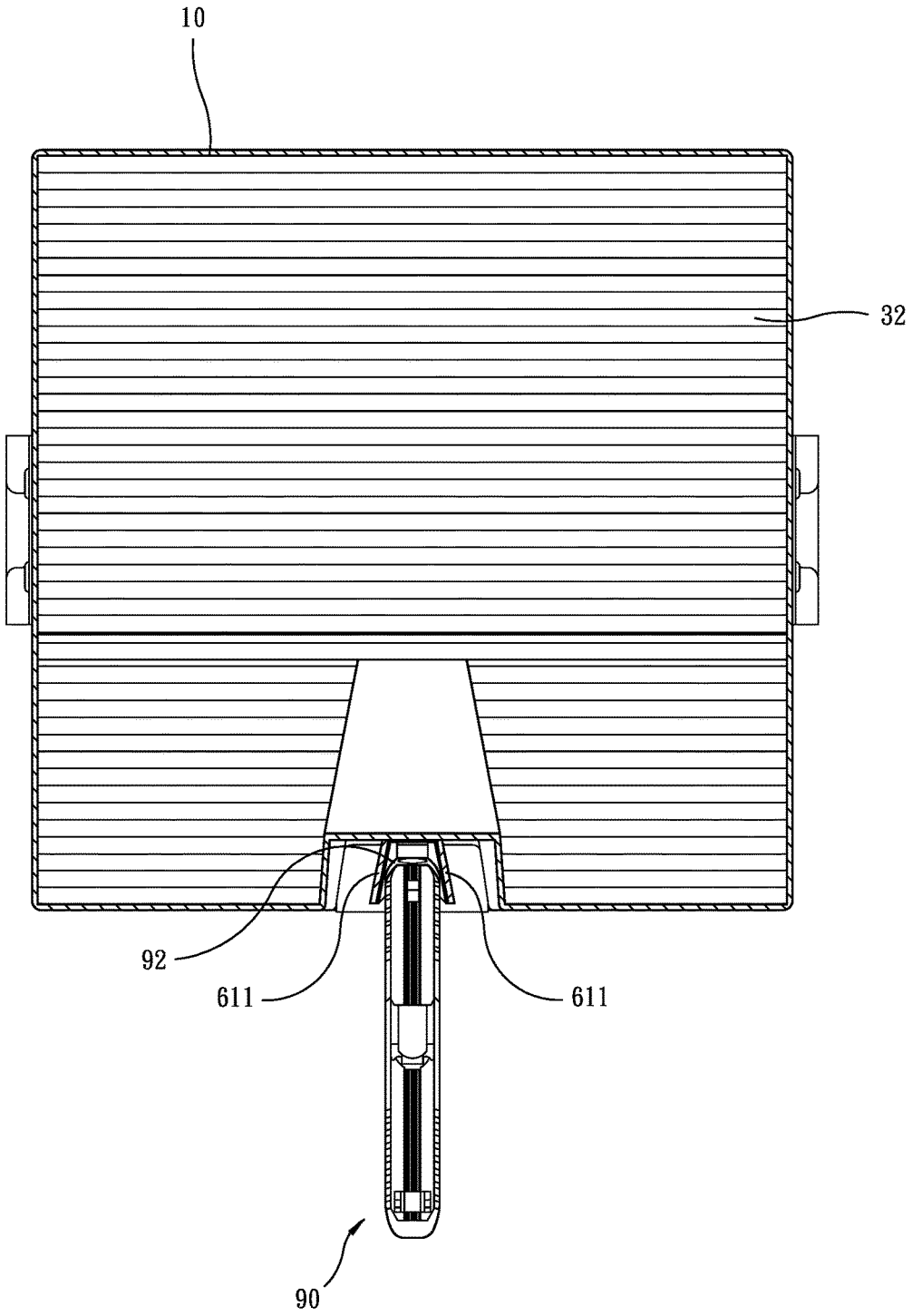
Figure 9:
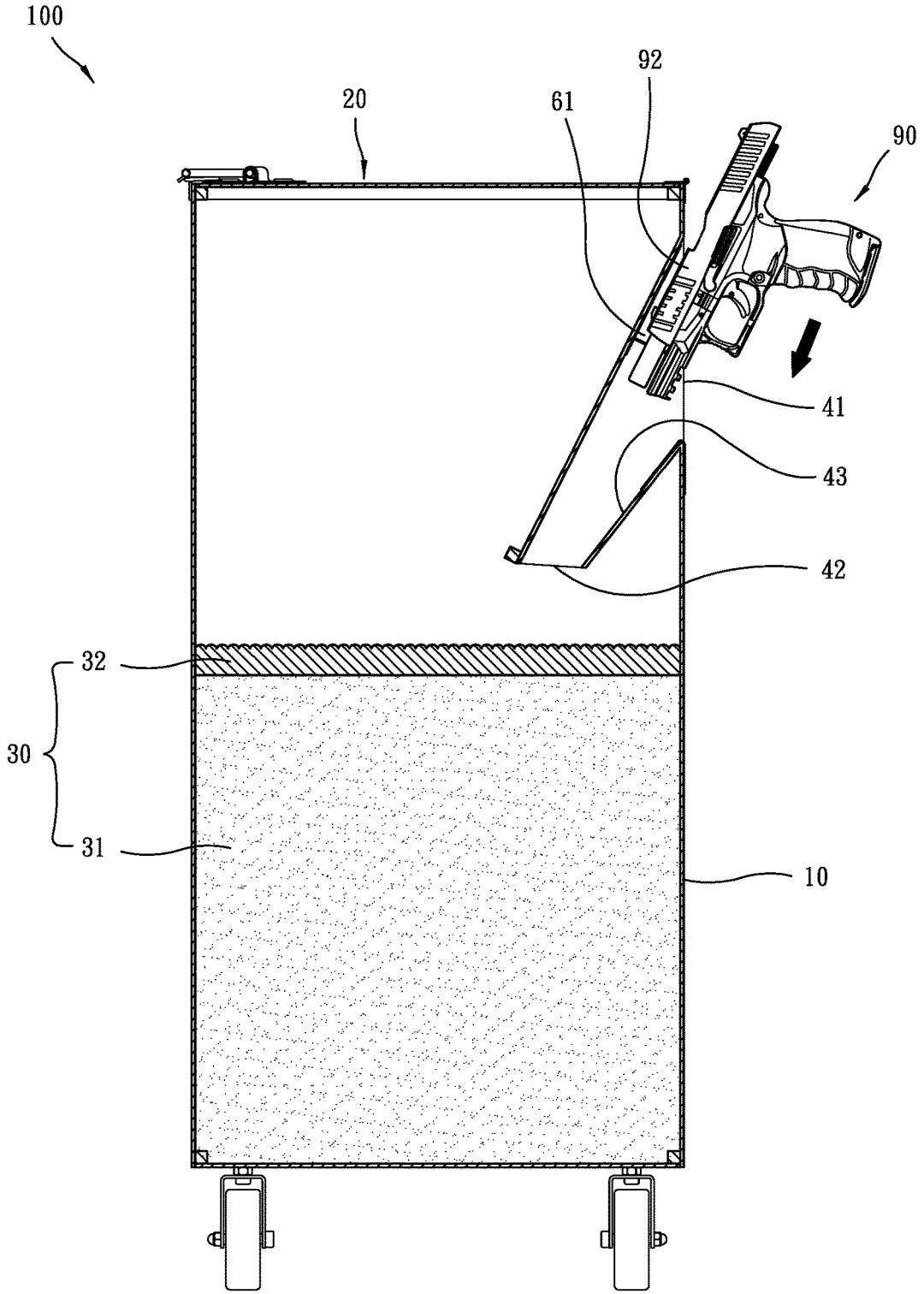
Figure 10:
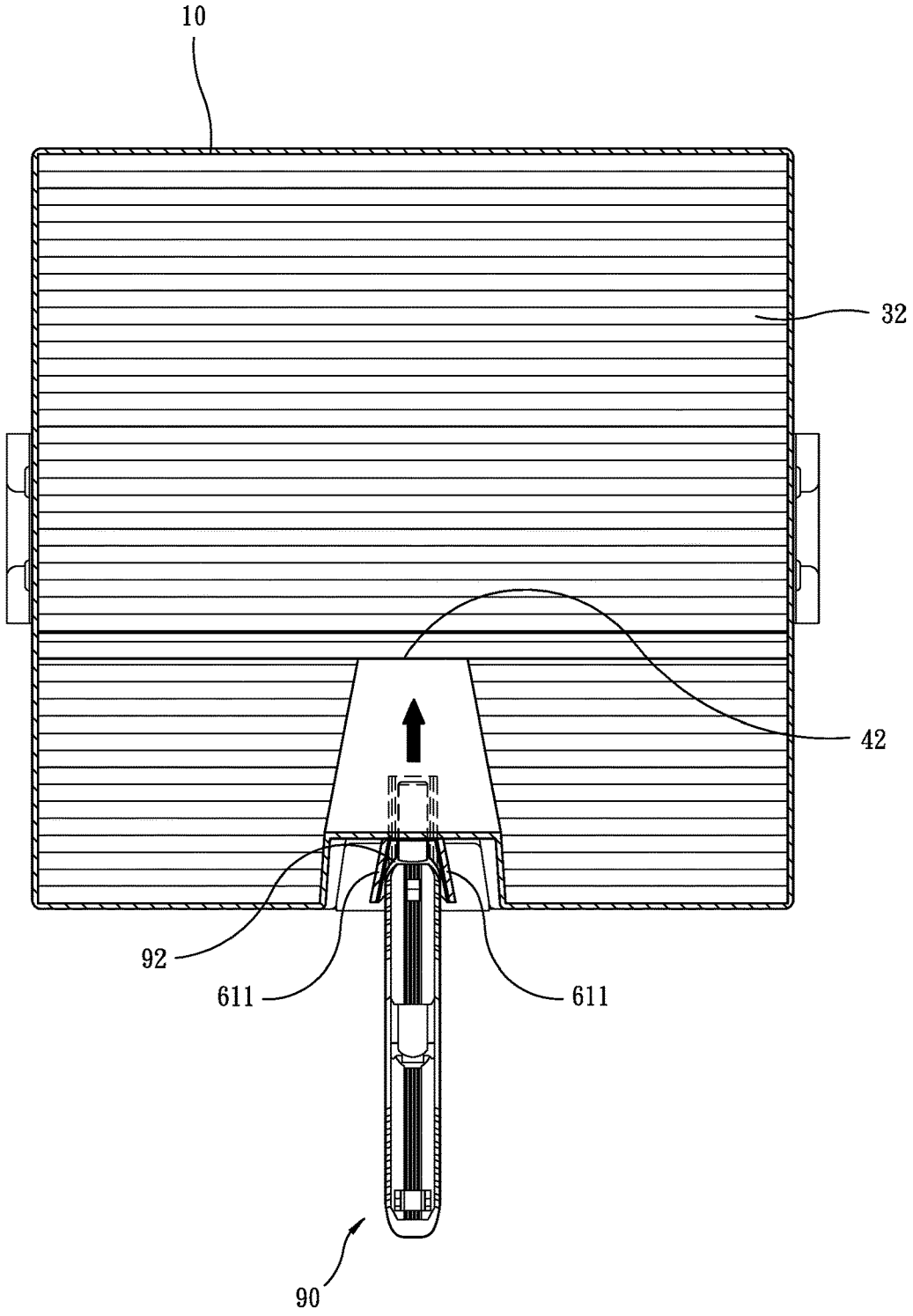
Figure 11:
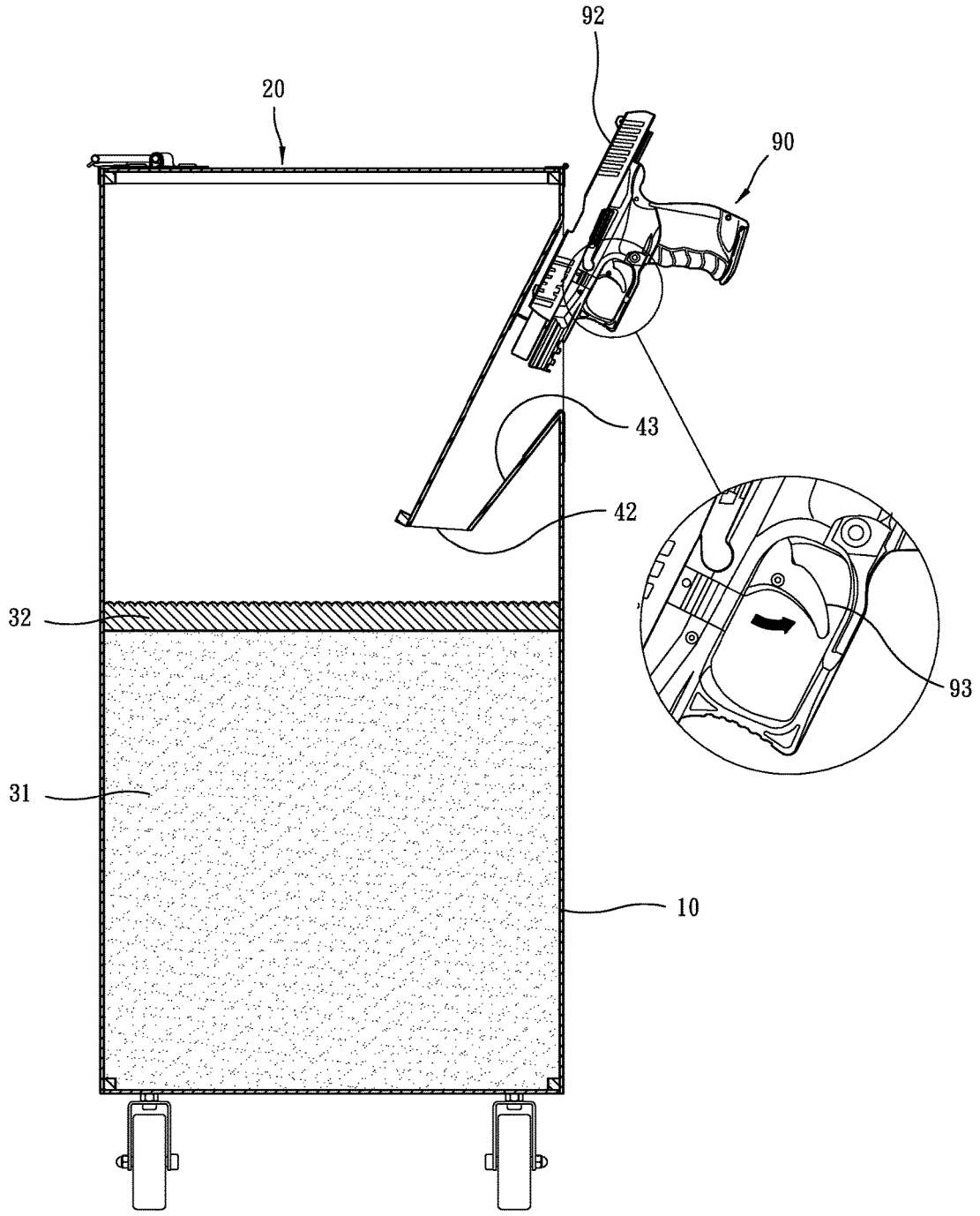

Therefore, the above is a description of the components of the gun-clearing box 100 and the assembly method thereof according to a preferred embodiment of the present invention, and then the features of the use will be described as follows:

When using the present invention to perform a gun-cleaning procedure on a pistol 90 (as shown in FIG. 5), first, withdraw out the magazine 91 of the pistol 90 (as shown in FIG. 6), then move the front end of the pistol 90 toward the placing entrance 41 of the gun-placing barrel 40 (as shown in FIG. 7), and make the front end of the sliding-sleeve 92 of the pistol 90 abut against the abutting surfaces 611 of the sliding-sleeve abutting assembly 60 (as shown in FIG. 8). In this way, the user can use the gesture which holds the pistol 90 with one hand and apply force to the pistol 90 toward the shot exit 42 (as shown in FIG. 9). Therefore, the abutting surfaces 611 with the tapered gap is abutted against the sliding-sleeve 92, and the sliding-sleeve 92 is pushed toward the rear end of the pistol 90 while the pistol 90 is applied force toward the shot exit 42 (as shown in FIG. 10). The action of pushing the sliding-sleeve 92 back is repeated twice for withdrawing the bullet, and then the trigger 93 of the pistol 90 can be buckled (as shown in FIG. 11). If there is no bullet fired out, the gun-cleaning procedure is completed. If there is any bullet fired out, the fired bullet will be shot toward the buffer-body 30 and stay in the buffer-body 30.

Therefore, in the present invention, the two abutting surfaces 611 can be abutted against the front end of the sliding-sleeve 92 of the pistol 90 by the inclined tapered gap, so that the user can complete the operation of pulling the sliding-sleeve 92 with one hand to improve the convenience of the gun-cleaning procedure.

Furthermore, in the present invention, the placing entrance 41 of the gun-placing barrel 40 has a barrel wall 43 with a predetermined length which is gradually reduced in inner diameter to the shot exit 42, so that even after the trigger 93 of the pistol 90 is buckled, if a bullet is struck, the bullet can be guided to the buffer-body 30 by the barrel wall 43 without directly hitting the box-body 10 to reduce the damage of the box-body 10.

Figure 12:
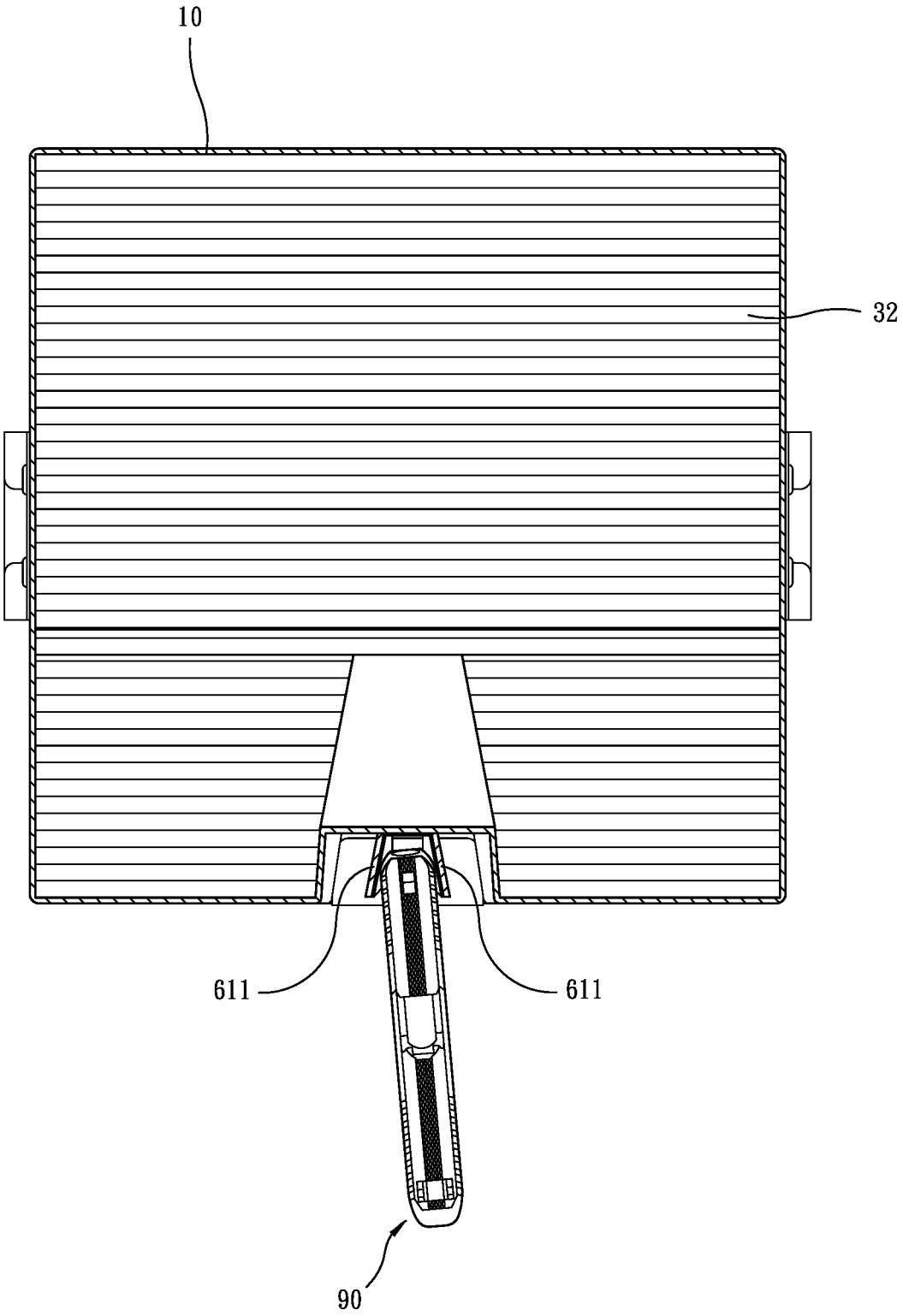

In addition, since the two abutting surfaces 611 of the sliding-sleeve abutting assembly 60 is inclined and tapered, if the front end of the sliding-sleeve 92 of the pistol 90 is inclined to abut and against the abutting surfaces 611 (as shown in FIG. 12), the sliding-sleeve 92 cannot be slid (that is, the barrel of the pistol 90 cannot be extended out) (as shown in FIG. 13). By means of this warning, it is impossible to complete the operation of pulling the sliding-sleeve 92 to prevent the pistol 90 from performing the gun-cleaning procedure in the deviated state to ensure the safety of the gun-cleaning procedure.

Next, in the above embodiment, the outer side of the box-body 10 can be further set with a grip handle 14, and the bottom of the box-body 10 can be set with a plurality of wheel-bodies 15 to be helpful for pulling the box-body 10 to move.

I claim:

1. A gun-clearing box, which mainly comprises:

a box-body having a gun-clearing space inside, wherein the top of the box-body has a cover opening connecting the gun-clearing space to the outside, and one side of the box-body has an assembly opening connecting the gun-clearing space to the outside;

a cover-body coupled to the box-body to close the cover opening;

a gun-placing barrel having an placing entrance, a shot exit, and a barrel wall connected between the placing entrance and the shot exit, wherein the diameter of the placing entrance is larger than the diameter of the shot exit, and the inner wall of the barrel wall is gradually reduced toward the shot exit from the placing entrance; wherein the gun-placing barrel is fixed in the assembly opening of the box-body, and the placing entrance is faced toward the outside of the box-body, and the shot exit is inclined to face toward the gun-clearing space; and a sliding-sleeve abutting assembly set in the gun-placing barrel, wherein the sliding-sleeve abutting assembly has two adjacent abutting surfaces, and has a gap between the two abutting surfaces; wherein the gap between the two abutting surfaces is inclined and reduced along the direction from the placing entrance to the shot exit.

2. The gun-clearing box according to claim 1, wherein the cover-body is pivotally coupled to the top of the box-body and can be reciprocally pivoted between an open position and a closed position; when the cover-body is in the open position, the cover opening of the box-body communicates with the outside; and when the cover-body is in the closed position, the cover opening of the box-body is closed.

3. The gun-clearing box according to claim 2, wherein the cover-body has a cover plate, a lifting handle, and a buckle 23; wherein the lifting handle is combined with a top surface of the cover body for hand grasping; and the buckle is set on the cover plate, which the buckle is buckled and combined with the box-body when the cover plate is in the closed position.

4. The gun-clearing box according to claim 1, further comprises a buffer-body disposed in the gun-clearing space of the box-body.

5. The gun-clearing box according to claim 4, wherein the buffer-body has a buffer main-body and a buffer surface-layer, which the buffer main-body is disposed in the gun-clearing space of the box-body, and the buffer surface-layer is covered on the top surface of the buffer main-body.

6. The gun-clearing box according to claim 1, further comprises a fastener connected between an outer wall of the gun-placing barrel and an inner wall of the gun-clearing space of the box-body.

7. The gun-clearing box according to claim 1, wherein the sliding-sleeve abutting assembly has two abutting pieces, which each of the abutting pieces is substantially L-shaped and is fixed in the barrel wall of the gun-placing barrel, and each of the abutting pieces has an adjacent abutting surface.

8. The gun-clearing box according to claim 1, further comprises a protective pad assembly of the gun-placing barrel which is a plurality of elastic pad-bodies attached to the barrel wall of the gun-placing barrel adjacent to the placing entrance.

9. The gun-clearing box according to claim 1, further comprises a sliding-sleeve protective pad assembly which is two elastic pad-bodies respectively attached to the abutting surfaces of the sliding-sleeve abutting assembly.

10. The gun-clearing box according to claim 1, wherein an outer side of the box-body is further set with a grip handle, and the bottom of the box-body is set with a plurality of wheel-bodies.

* * * * *